US008430683B2

(12) United States Patent
Kurakagi

(10) Patent No.: US 8,430,683 B2
(45) Date of Patent: Apr. 30, 2013

(54) ELECTRONIC APPARATUS EQUIPPED WITH CONNECTORS

(75) Inventor: Keiji Kurakagi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 13/137,872

(22) Filed: Sep. 20, 2011

(65) Prior Publication Data

US 2012/0015548 A1 Jan. 19, 2012

Related U.S. Application Data

(63) Continuation of application No. PCT/JP2009/056481, filed on Mar. 30, 2009.

(51) Int. Cl.
*H01R 13/64* (2006.01)

(52) U.S. Cl.
USPC ..... 439/374; 439/488

(58) Field of Classification Search ..... 439/374, 439/488, 491
See application file for complete search history.

(56) References Cited

U.S. PATENT DOCUMENTS

| | | | | |
|---|---|---|---|---|
| 3,966,290 | A * | 6/1976 | Little et al. | 439/74 |
| 5,613,881 | A * | 3/1997 | Ichida et al. | 439/680 |
| 6,461,189 | B1 * | 10/2002 | Koh | 439/491 |
| 7,229,308 | B2 * | 6/2007 | Ishikawa | 439/374 |
| 7,980,886 | B2 * | 7/2011 | Liu | 439/488 |
| 2003/0220009 | A1 | 11/2003 | Takeguchi et al. | |
| 2006/0160382 | A1 | 7/2006 | Nishida et al. | |
| 2009/0036001 | A1 * | 2/2009 | Ishigami | 439/816 |

FOREIGN PATENT DOCUMENTS

| | | |
|---|---|---|
| JP | 3000303 | 8/1994 |
| JP | 2003-345464 | 12/2003 |
| JP | 2004-241331 | 8/2004 |
| JP | 2006-202817 | 8/2006 |

OTHER PUBLICATIONS

International Search Report for PCT/JP2009/056481 mailed Jun. 16, 2009.

* cited by examiner

*Primary Examiner* — Gary F. Paumen
(74) *Attorney, Agent, or Firm* — Staas & Halsey LLP

(57) ABSTRACT

An electronic apparatus includes a connector provided to a surface of a housing; and a guide part configured to guide a connection connector, which is to be connected to the connector, to a connecting position. The guide part includes a pair of width direction guide surfaces and a height direction guide surface. The width direction guide surfaces guide the connection connector to the connecting position with respect to a direction of width of the connector by sandwiching the connection connector therebetween in the direction of width. The height direction guide surface guides the connection connector to the connecting position with respect to a direction of height of the connector in a state where the connection connector is in contact with the height direction guide surface.

15 Claims, 17 Drawing Sheets

ELECTRONIC APPARATUS EQUIPPED WITH CONNECTORS

CROSS-REFERENCE TO RELATED APPLICATIONS

This application is a U.S. continuation application, filed under 35 USC 111(a) and claiming the benefit under 35 USC 120 and 365(c), of PCT application JP2009/056481 filed Mar. 30, 2009. The foregoing application is hereby incorporated herein by reference.

FIELD

The embodiment discussed herein is directed to an electronic apparatus equipped with connectors.

BACKGROUND

For example, an electronic apparatus such as a monitor device used as a display device of a computer or a video device is equipped with connectors (connector terminals) for connecting a power supply cable, a data communication cable and the like in many cases. Usually, a monitor device serving as a display device is equipped with a plurality of connectors, such as a power supply connector, a data line connector for inputting display image data, an audio input line connector, an audio output line connector, a video output line connector, etc.

Because a front face of the monitor device serves as an image display part such as a liquid-crystal display device, many connectors are provided on a rear face or a side face of the monitor device. For example, Japanese Laid-Open Patent Application No. 2006-202817 discloses a housing of a monitor device having a rear face provided with a recessed portion so that a downwardly-facing face is formed and a plurality of connectors are provided on the downwardly-facing surface. There may be a case where a housing of a monitor device has a laterally-facing face provided with a recessed portion so that the laterally-facing face is formed and a plurality of connectors are provided on the laterally-facing surface.

In order to connect a connection line to the above-mentioned connector of the monitor device, a connector of a connection line must be inserted into the connector of the monitor device after checking the position of the connector of the monitor device and aligning the connector of the connection line with the connector of the monitor device. If the connector is provided on a rear face of a housing of the monitor device, which is an example of an electronic apparatus, a person who is connecting a line must check the position of the connector of the monitor device while looking into the rear face of the monitor device. Moreover, if the connector is provided on a downwardly-facing face on the rear face, the person must visually recognize the connector while looking into the rear side from a lower side. In such a case, the person who is connecting the connection line attempts to insert the connector of the connection line into the connector of the monitor device after merely recognizing an approximate position of the connector of the monitor device. Usually, many pins are provided in the connector of the connection line or the connector of the monitor device, and one of the connectors making a pair is connected to the other of the connectors by inserting the pins of the one of the connectors into pin holes of the other of the connectors. If a person attempts to insert the one of the connectors into the other of the connectors while merely recognizing an approximate position of the other of the connectors, the pins of the one of the connectors may be obliquely inserted into the pin holes of the other of the connectors in a state where the pins are not accurately aligned with the pin holes. In such a case, there may be a problem in that an undesired force is applied to the pins which results in bending the pins.

Moreover, there may be a case where it is difficult to check the position of the connector because a plurality of connectors having similar shapes are provided on a rear face of a housing of a monitor device in many cases. If an attempt is made to connect a connector to a connector having a different terminal configuration, there also may be a problem in that an undesired force is applied to the pins which results in bending the pins.

Such a problem can be avoided if a connector of a connection line can be connected to a connector of an electronic apparatus by merely checking an approximate position of the connector of the electronic apparatus without recognizing an accurate position of the connector of the electronic apparatus.

SUMMARY

According to an aspect of the invention, an electronic apparatus equipped with a connector, includes: the connector provided to a surface of a housing; and a guide part configured to guide a connection connector, which is to be connected to the connector, to a connecting position, wherein the guide part includes a pair of width direction guide surfaces and a height direction guide surface, the width direction guide surfaces guiding the connection connector to the connecting position with respect to a direction of width of the connector by sandwiching the connection connector therebetween in the direction of width, the height direction guide surface guiding the connection connector to the connecting position with respect to a direction of height of the connector in a state where the connection connector is in contact with the height direction guide surface.

The object and advantages of the embodiment will be realized and attained by means of the elements and combinations particularly pointed out in the appended claims.

It is to be understood that both the foregoing general description and the following detailed description are exemplary explanatory only and are not restrictive of the invention, as claimed.

DESCRIPTION OF EMBODIMENT(S)

Preferred embodiment of the present invention will be explained with reference to the accompanying drawings.

Figure 1:
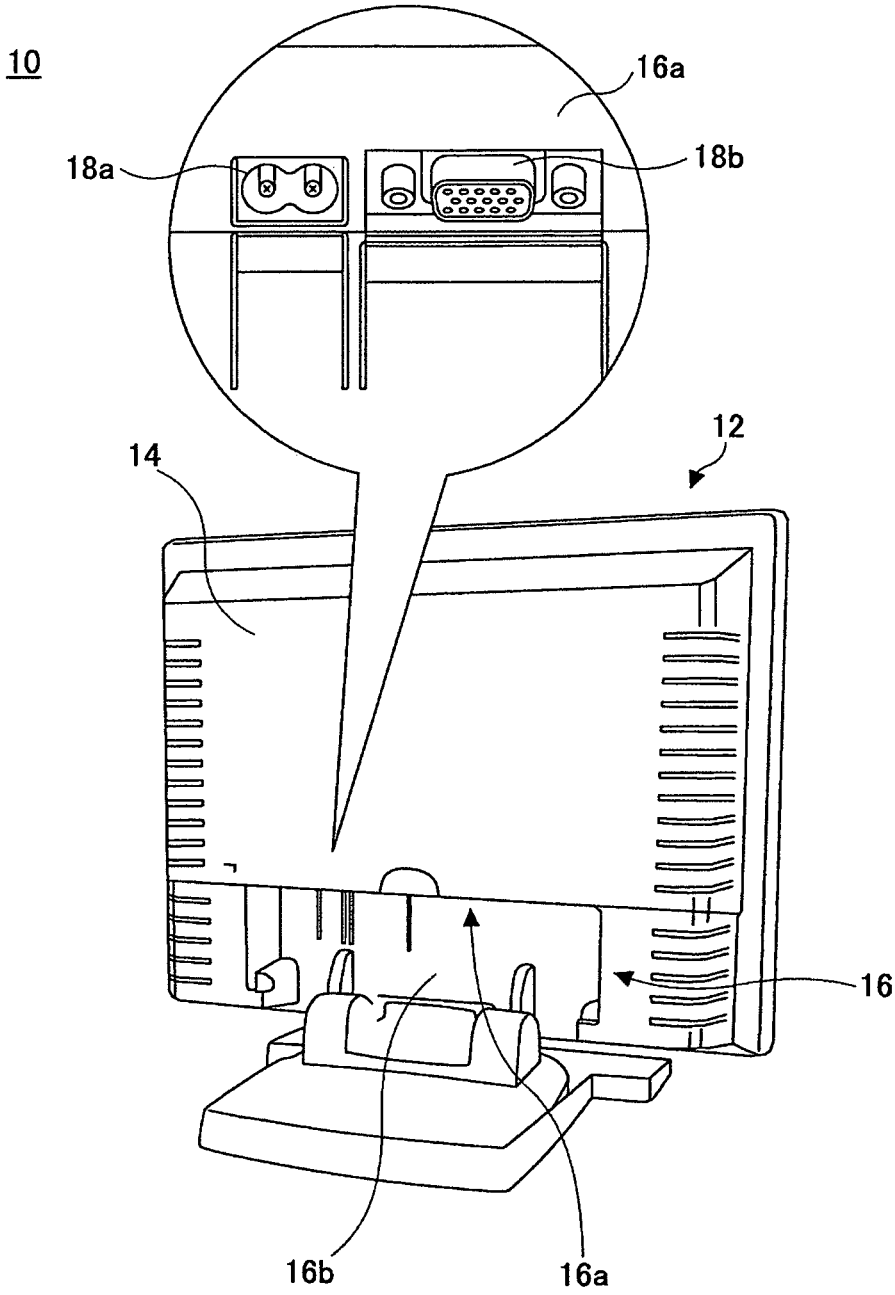
FIG. 1 is a perspective view of a monitor device according to a first embodiment, viewed from a rear-face side.

FIG. 1 is a perspective view of a monitor device according to a first embodiment, viewed from a rear-face side. The monitor device illustrated in FIG. 1 is an example of an electronic apparatus equipped with connectors, and is a liquid-crystal display device serving as a display apparatus of a personal computer.

A concave part 16 is formed in a rear face 14 of a housing 12 of the monitor device 10, and a plurality of connectors are exposed from a downward-facing surface 16*a*, which faces in a downward direction in an upper part of the concave part 16. FIG. 1 illustrates an enlarged view of a portion of the downward-facing surface 16*a*. A power supply line connector 18*a* and a display signal input line connector 18*b* are illustrated in the enlarged view.

Figure 2:
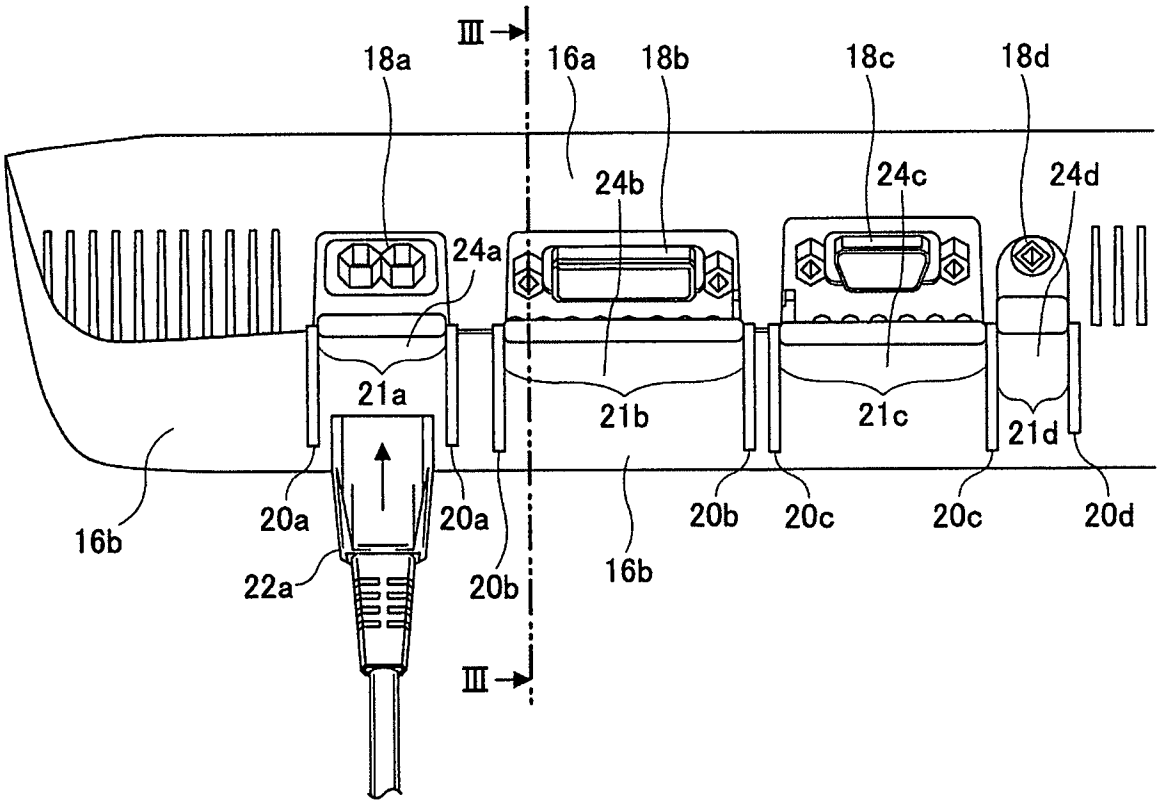
FIG. 2 is a view of a part where connectors are provided.

FIG. 2 is a view of a part of the concave part 16 where connectors 18*a*, 18*b*, 18*c* and 18*d* are provided. As illustrated in FIG. 2, the downward-facing surface 16*a* of the concave part 16 is provided with the video display signal input line connector 18*c* and the audio signal input line connector 18*d* besides the power supply line connector 18*a* and the data signal input line connector 18*b*. The connectors 18*a*, 18*b*, 18*c* and 18*d* have different shapes and different number of pins.

The operation to connect connectors to the respective connectors 18*a*, 18*b*, 18*c* and 18*d* must be performed while checking positions of the connectors 18*a*, 18*b*, 18*c* and 18*d* by looking into the downward-facing surface 16*a*, which operation is inconvenient and difficult to do by an operator. Thus, according to the present embodiment, as illustrated in FIG. 2, guide molds 20*a*, 20*b*, 20*c* and 20*d* are formed in the positions corresponding to connectors 18*a*, 18*b*, 18*c* and 18*d* as guide projection parts on the bottom surface 16*b* of the concave part 16.

The guide molds 20*a*, 20*b*, 20*c* and 20*d*, which serve as guide projection parts, are rib-shaped projections integrally formed on the surface of the housing 12, which is formed as a plastic mold product. The guide molds 20*a*, 20*b*, 20*c* and 20*d* guide the connection connectors to be inserted into the connectors 18*a*, 18*b*, 18*c* and 18*d*, respectively, so as to accurately lead the connectors to the connecting positions of the connectors 18*a*, 18*b*, 18*c* and 18*d*, respectively.

A description is given below of a guide function of the guide molds 20*a*, 20*b*, 20*c* and 20*d* with reference to the guide molds 20*a* as an example. Two guide molds 20*a* are provided at positions corresponding to both sides of the connector 18*a*. A width Dl between the two guide molds 20*a* is slightly larger than a width of the connection connector 22*a* to be inserted into the connector 18*a*. By placing the connection connector 22*a*, which is to be inserted into the connector 18*a*, between the two guide molds 20*a* and moving the connection connector 22*a* toward the connector 18*a*, the connection connector 22*a* moves in a space between the two guide molds 20*a* and is accurately lead to the connecting position with the connector 18*a*.

Although there is no limitation in the height of the guide molds 20*a*, which are guide projection parts projecting from the bottom surface 16*b* of the concave part 16, it is desirable to set the height of the guide molds 20*a* to a level such that guide molds 20*a* can guide the connection connector 22*a*. If the height of the guide molds 20*a* is too high, an operation of catching the connection connector 22*a* by fingers and pushing it into the connector 20*a* is difficult to do. Accordingly, it is desirable to set the height of the guide molds 20*a* projecting from the bottom surface 16*b* to a level such that, when the connection connector 22*a* is placed between the guide molds 22*a* and pressed against the bottom surface 16*b*, the fingers can touch opposite side surfaces of the connector 22*a* to catch the connector 22*a*.

The guide function according to the above-mentioned pair of guide molds 20*a* is a guide function with respect to a direction of width of the connection connector 22*a*. Thus, in order to provide a guiding function with respect to the direction of thickness or the height of the connection connector 22*a* (a direction perpendicular to the paper surface of FIG. 2), a raised portion 24*a* is provided on the bottom surface 16*b* of the concave part 16. Similarly, raised portions 24*b*, 24*c* and 24*d* are provided with respect to the connectors 18*b*, 18*c* and 18*d*. The raised portions 24*a*, 24*b*, 24*c* and 24*d* are protruding portions formed by partially raising the bottom surface 16*b* of the concave part 16, and are formed at positions in front of the connectors 18*a*, 18*b*, 18*c* and 18*d*, respectively.

Figure 3:
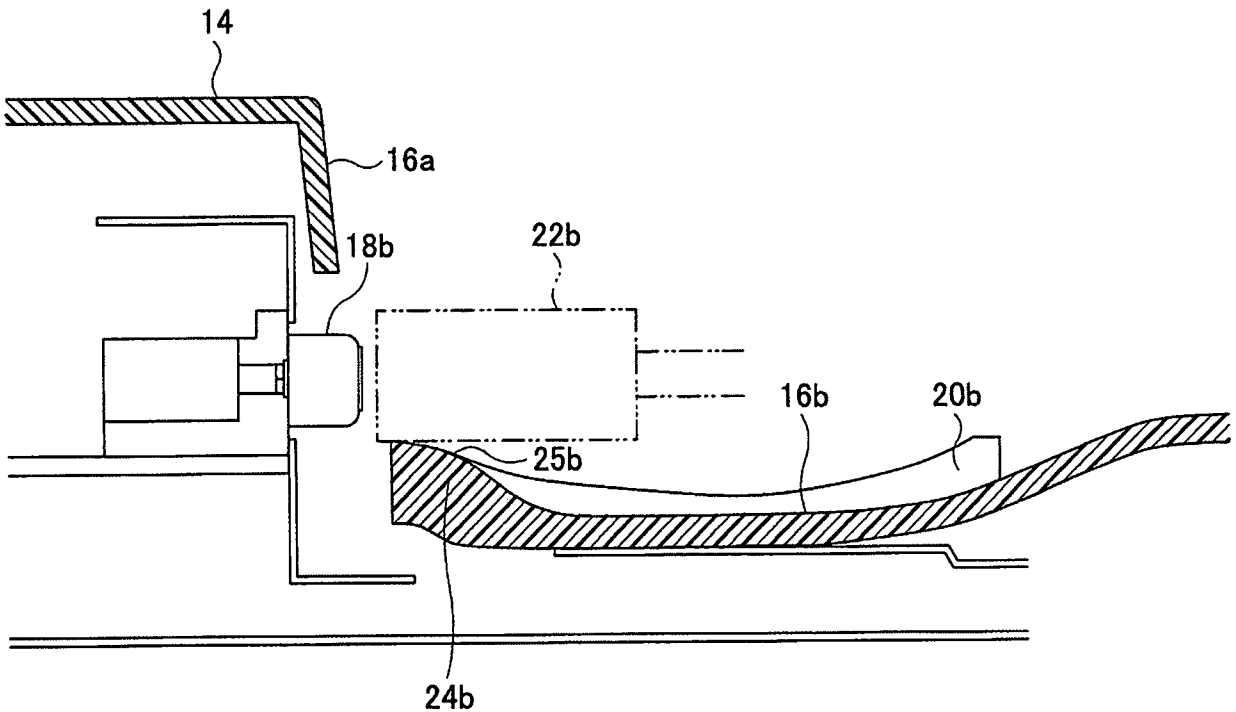
FIG. 3 is a cross-sectional view taken along a line III-III of FIG. 2.

A description is given below of a guiding function of the raised portions 24*a*, 24*b*, 24*c* and 24*d* with reference to the raised portion 24*b* as an example. FIG. 3 is a cross-sectional view taken along a line III-III of FIG. 2.

The raised portion 24*b* is a portion raised from the bottom surface 16*b* of the concave part 16 at a position in front of the connector 18*b* illustrated in FIG. 3. An upper surface (surface) 25*b* of the raised portion 24*b* serves as a height direction guide surface which guides the connection connector 22*b* to be lifted from the bottom surface 16*b* of the concave part 16 so that the connection connector 22*b* is positioned at a height of the connector 18*b*. That is, when the connection connector 22*b* is moved from a position slightly remote from the connector 18*b* toward the connector face 10*b* by causing the connection connector 22*b* to slide on the bottom surface 16*b*, the connection connector 22*b* overrides the upper surface 25*b* of the raised portion 24*b* at a position close to the connector 18*b*, and, finally, the connection connector 22*b* is set at a height (position) the same as the connector 18*b*. At this time, because the connection connector 22*b* is guided with respect to the direction of width by the guide molds 20*b*, the connection connector 22*b* is guided both in the direction of width and the direction of height (direction of thickness), and is accurately lead to the connecting position with the connector 18*b*.

It should be noted that because the connector 18*c* and the connector 18*d* are close to each other, there is no space to provide two guide molds between the connector 18*c* and the connector 18*d*. Thus, only one guide mold 20*c* is provided between the connector 18*c* and the connector 18*d*. The guide mold 20*c* makes a pair with another guide mold 20*c* located on opposite side so as to serve as a guide of the connection connector 22*c* being connected to the connector 18*c* (refer to FIG. 10). Additionally, the guide mold 20*c* makes a pair with a guide mold 20*d* so as to serve as a guide of the connection connector 22*d* to be connected to the connector 18*d* (refer to FIG. 10).

As mentioned above, according to the present embodiment, the connection connectors 22*a*, 22*b*, 22*c* and 22*d* being connected to the connectors 18*a*, 18*b*, 18*c* and 18*d* are lead to the respective connecting positions by providing the guide molds 20*a*, 20*b*, 20*c* and 20*d* and the raised portions 24*a*, 24*b*, 24*c* and 24*d*, which provides guide surfaces, on the rear surface of the housing 12 of the monitor device 10. Accordingly, the connection connectors 22*a*, 22*b*, 22*c* and 22*d* can be accurately guided to the connecting positions by merely placing and moving the connection connectors 22*a*, 22*b*, 22*c* and 22*d* between the corresponding pairs of the guide molds 20*a*, 20*b*, 20*c* and 20*d*, thereby avoiding a problem such as bending of pins due to forced insertion with misalignment. Because the guide molds 20*a*, 20*b*, 20*c* and 20*d* and the raised portions 24*a*, 24*b*, 24*c* and 24*d* are integrally formed with the plastic mold housing 12 so as to be portions of the housing 12, there is no need to add any special parts that provide a guide function, thereby avoiding an increase in the manufacturing cost of the monitor device 10.

Figure 4:
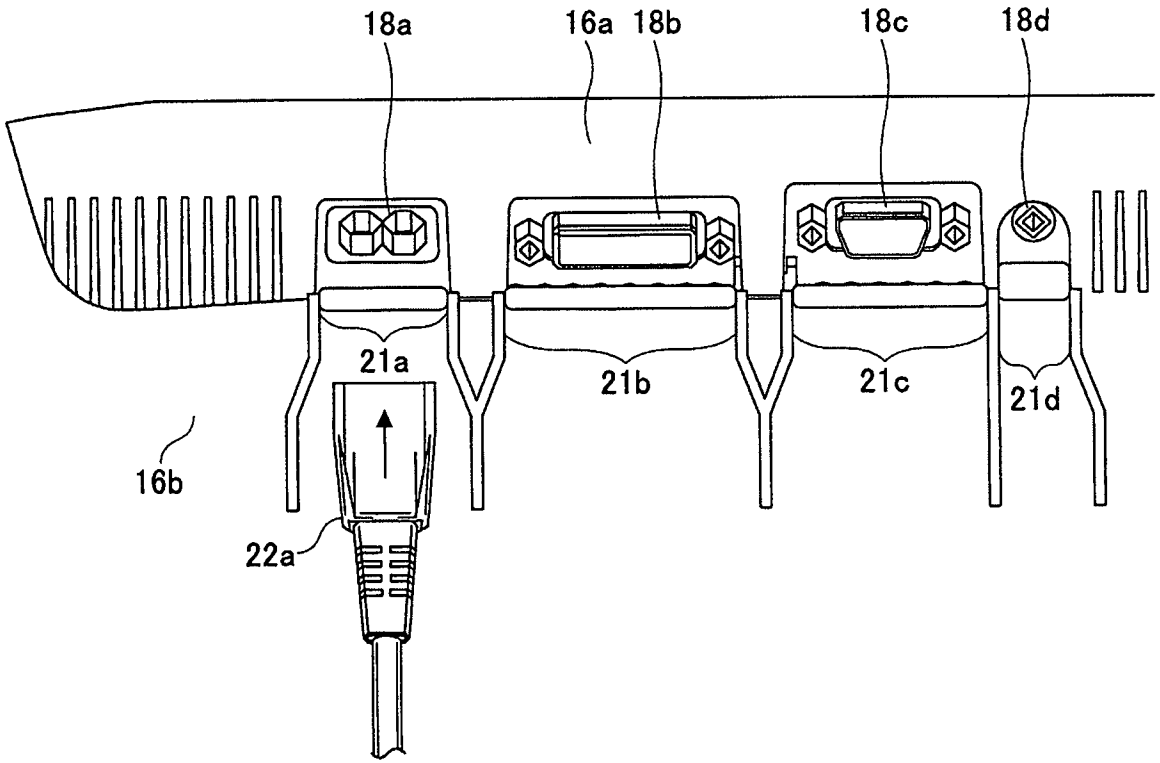
FIG. 4 is a view indicating a variation of a guide mold illustrated in FIG. 2.

In the present embodiment, a distance between a pair of guide molds is set slightly larger than the corresponding connection connector. However, the distance between the pair of guide molds may be set larger at a position remote from the connector and gradually reduced as it goes close to the connector so that the distance becomes slightly larger than the width of the connector at a position slightly before the connecting position at which the connection connector is connected to the connector. FIG. 4 illustrates such pairs of guide molds.

In FIG. 4, the distance between the pair of guide molds 20*a* is gradually reduced as it goes closer to the connector 18*a* so that the distance is slightly larger than the width of the connection connector 22*a* at a position close to the connector 18*a*. Therefore, the connection connector 22*a* can be easily positioned relative to the connector 18*a* by first placing the connection connector 22*a* in a portion where the distance between the pair of guide molds 20*a* is large and, then, moving the connection connector 22*a* toward the connector 18*a*. That is, a freedom of position at which the connection connector 22*a* is placed first is increased.

Therefore, even in a case where the guide molds 20*a* cannot be recognized visually, an approximate position at which the connection connector 22*a* is placed can be recognized by touching the rear surface 14 of the housing 12 by fingers and, thereafter, the connection connector 22*a* can be placed at that position. Thereby, the connection connector 22*a* can be placed between the pair of guide molds 20*a*. Although the position at which the connection connector 22*a* is placed can be recognized by finger touch even in the case where the guide molds 20*a* have a linear shape such as illustrated in FIG. 2, the connection connector 22*a* can be more easily placed without visual recognition of the guide molds 20*a* when the connection connector 22*a* is placed at a portion where the distance between the pair of guide molds 20*a* is larger.

It should be noted that, in the example illustrated in FIG. 4, the guide mold 20*a* and the guide mold 20*b* adjacent to the guide mold 20*a* are merged at a portion where the distance between the guide molds 20*a* is large. Accordingly, the guide mold positioned between the connector 18*a* and the connector 18*b* has a single base portion and the base portion on the side close to the connectors 18*a* and 18*b* is bifurcated into two portions, which correspond to the guide mold 20*a* and the guide mold 20*b*.

In the example illustrated in FIG. 4, the above-mentioned structure of the guide mold 20*a* is applied to other guide molds 20*b*, 20*c* and 20*d*.

Figure 5:
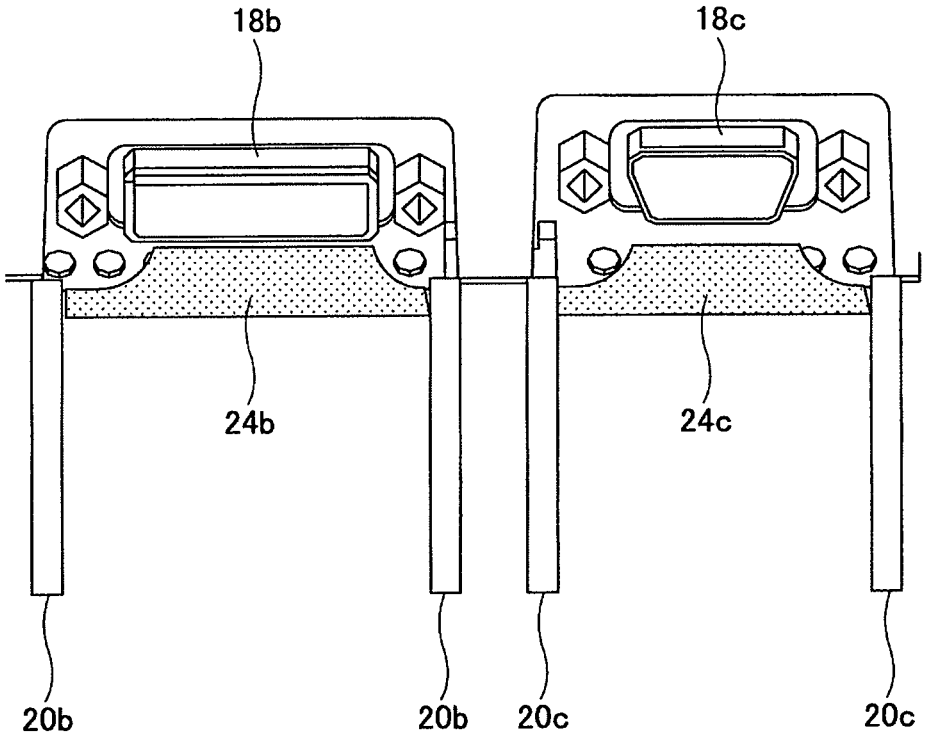
FIG. 5 is a view indicating a variation of a raised part illustrated in FIG. 2.

FIG. 5 is a view illustrating a variation of the raised portions 24*b* and 24*c*. The connection connectors 22*b* and 22*c* connected to the connectors 18*b* and 18*c* have screws for fixation, respectively, so that the connection connectors 22*b* and 22*c* can be fixed in a connected state by screwing the fixing screws into screw holes provided on both sides of each of the connectors 18*b* and 18*c*. Therefore, an operation of turning the fixing screws must be performed after connecting the connection connectors 22*b* and 22*c* to the connectors 18*b* and 18*c*.

The operation to turn the fixing screws on both sides after the connection is an action to turn the fixing screws while pinching the fixing screws by fingers. Accordingly, if the raised portions 24*b* and 24*c* extend to near the fixing screws, the raised portions 24*b* and 24*c* may prevent the operation to turn the fixing screws by fingers. Thus, in the example illustrated in FIG. 5, both sides of each of the raised portions 24*b* and 24*c* are removed. The both sides of each of the raised portions 24*b* and 24*c* are not actually removed but the raised portions 24*b* and 24*c* are formed initially with such a shape with both sides removed. Thereby, the fixing screws can be turned easily by fingers without the fingers contacting the raised portions 24*b* and 24*c*.

Figure 6:
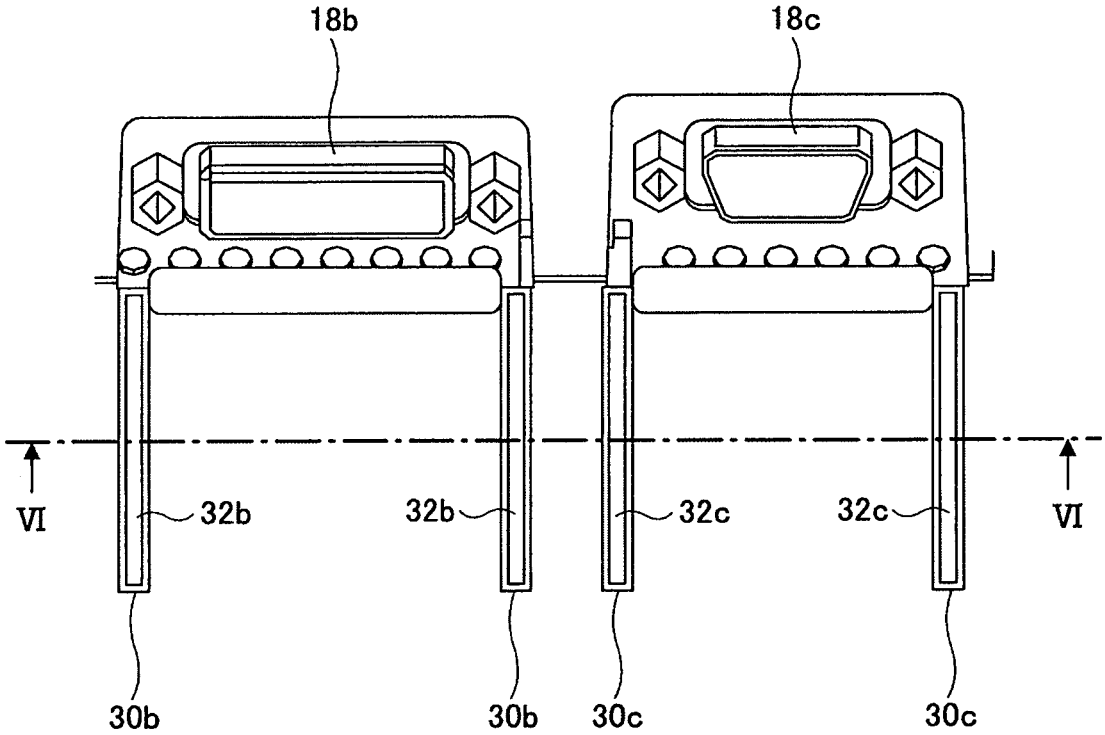
FIG. 6 is a view indicating a variation of a protruding part illustrated in FIG. 2.
Figure 7:
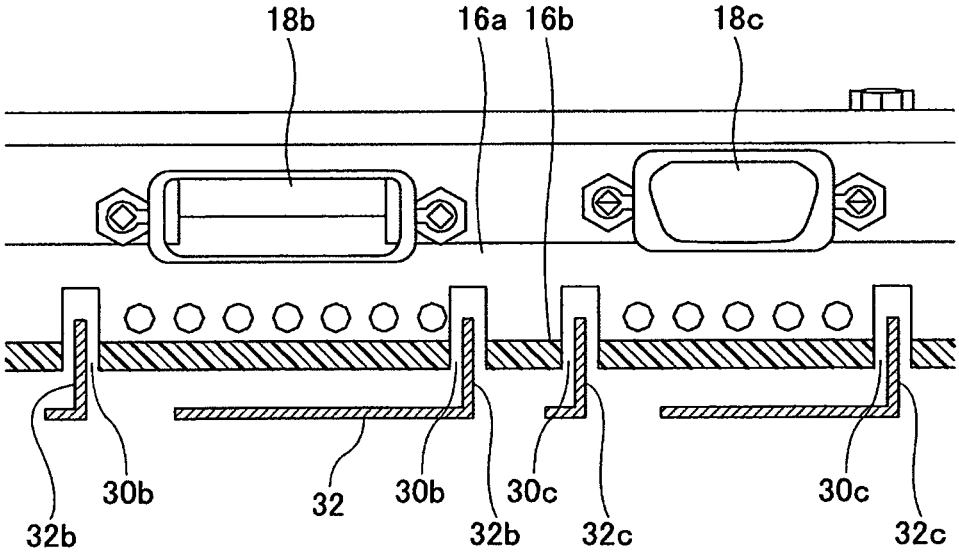
FIG. 7 is a cross-sectional view taken along a line VI-VI of FIG. 6.

Although the guide projection part, which provides the guide function in the direction of width, corresponds to the guide mold formed in the housing 12 in the present embodiment, the guide projection part providing the guide function may be formed by cutting and raising a metal part of a chassis or the like in the housing 12 and causing the thus-formed metal cut portion to pierce the housing 12 as illustrated in FIGS. 6 and 7.

As illustrated in FIG. 6, slits 30*b* and 30*c* are formed in the bottom surface 16*b* of the concave part 16 of the housing 12 at positions where the guide olds 20*b* and 20*c* are to be provided. Then, as illustrated in FIG. 7, portions of a metal plate part 32 provided inside the bottom surface 16*b* are cut and raised to form metal plate guide parts, which penetrate through the slits 30*b* and 30*c* and extend to outside the housing 12. The side surfaces of the metal plate guide parts 32*b* and 32*c* extending outside the housing 12 provide the guide function as the side surfaces 21*b* and 21*c* of the above-mentioned guide molds 20*b* and 20*c*.

When the metal plate part 32 in which the metal plate guide parts 32*b* and 32*c* are formed is grounded, electric charges accumulated in the connection connectors 22*b* and 22*a* and in tips of fingers are discharged to the metal plate part. Thereby, a discharge from the connection connectors 22*b* and 22*c* can be prevented when connecting the connection connectors 22*b* and 22*c* to the connectors 18*b* and 18*c*. It should be noted that although the metal plate guide parts 32*b* and 32*c* provided to the connectors 18*b* and 18*c* having a relatively large width are illustrated in FIG. 6 and FIG. 7, slits and metal plate guide parts may be provided instead of the guide molds similar to other connectors 18*a* and 18*d*.

A description will be given, with reference to FIG. 8 and FIG. 9, of a second embodiment. In the second embodiment, instead of providing guide function to the projection part as in the first embodiment, guide grooves or guide concave parts 40*b* and 40*c* are formed on the bottom surface 16*b* in order to guide the connection connectors.

The widths of the guide concave parts 40*b* and 40*c* is slightly larger than the widths of the connection connectors 22*b* and 22*c*, respectively, in order to guide the connection connectors 22*b* and 22*c*. That is, the both side surfaces of each of the guide concave parts 40*b* and 40*c* serve as width direction guide surfaces to guide the movement of the connection connectors 22*b* and 22*c* in a direction toward the connectors 18*b* and 18*c*.

Moreover, similar to the height of the guide molds, it is desirable that the depth of the guide concave parts 40*b* and 40*c* is set to a depth so that the connection connectors 40*b* and 40*c* can be pinched by fingers by contacting the fingers with the both side surfaces of each of the connection connectors 22*b* and 22*c* when the connection connectors 22*b* and 22*c* are placed inside the guide concave parts 40*b* and 40*c* and pressed against the bottom surface of the guide concave parts 40*a* and 40*c*, respectively.

Figure 8:
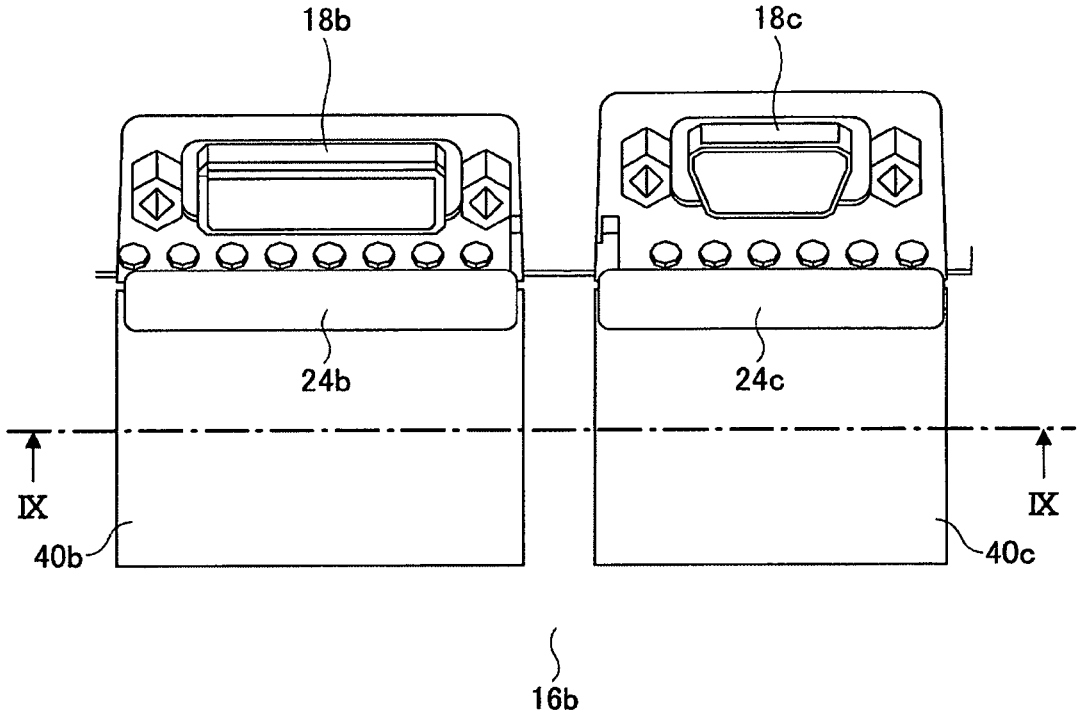
FIG. 8 is a view indicating a guide part according to a second embodiment.

Also in the present embodiment, similar to the first embodiment, the raised portions 24*b* and 24*c* are provided to provide the guide function with respect to the direction of thickness of the connection connectors 22*b* and 22*c* (in a direction perpendicular to the paper surface of FIG. 8).

Figure 9:
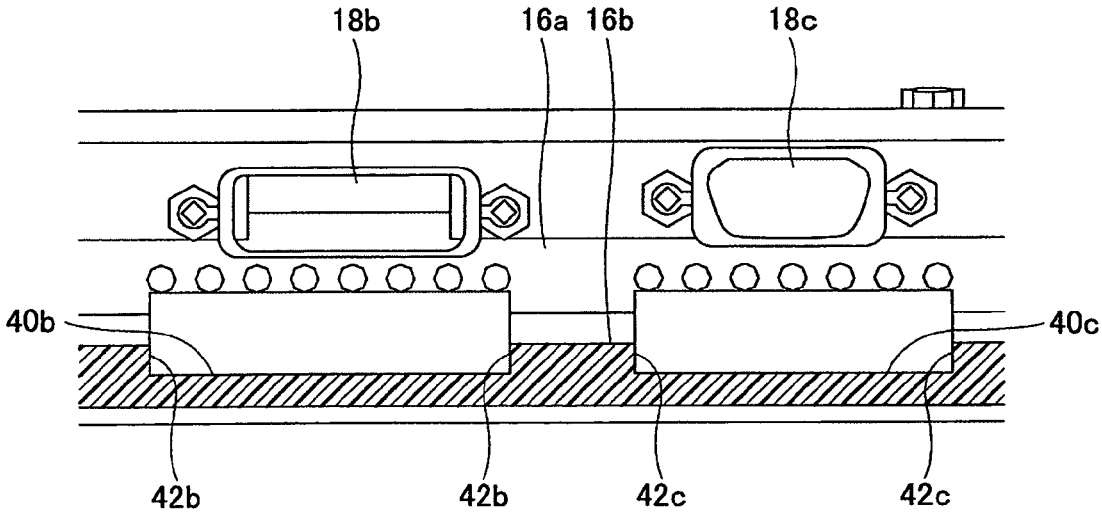
FIG. 9 is a cross-sectional view taken along a line IX-IX of FIG. 8.

Although FIG. 8 and FIG. 9 illustrate providing the guide concave parts 40*b* and 40*c* to the connectors 18*b* and 18*c*, guide concave parts having the same structure may be provided to other connectors 18*a* and 18*d*.

As mentioned above, according to the present embodiment, the connectors 22*b* and 22*c*, which are to be connected to the connectors 18*b* and 18*c*, are lead to the respective connecting positions by providing the guide concave parts 40*b* and 40*c* providing the width direction guide surfaces and the raised portions 24*b* and 24*c* on the rear surface 14 of the housing of the monitor device 10. Accordingly, the connection connectors 22*b* and 22*c* can be accurately guided to the connecting positions by merely placing the connection connectors 22*b* and 22*c* inside the guide concave parts 40*b* and 40*c* and moving them toward the connectors 18*b* and 18*c*, thereby avoiding a problem such as bending of pins due to forced insertion with misalignment. Because the guide concave parts 40*b* and 40*c* and the raised portions 24*b* and 24*c* are integrally formed with the plastic mold housing 12 so as to be portions of the housing 12, there is no need to add any special parts that provide a guide function, thereby avoiding an increase in the manufacturing cost of the monitor device 10.

In the present embodiment, a distance between both side surfaces 42*b* and 42*c* of the guide concave parts 40*b* and 40*c* is set slightly larger than the corresponding connection connector. However, the distance between the both side surfaces 42*b* and 42*c* may be set larger at a position remote from the connector and gradually reduced as it goes close to the connector so that the distance becomes slightly larger than the width of the connector at a position slightly before the connecting position at which the connection connector is connected to the connector.

Figure 10:
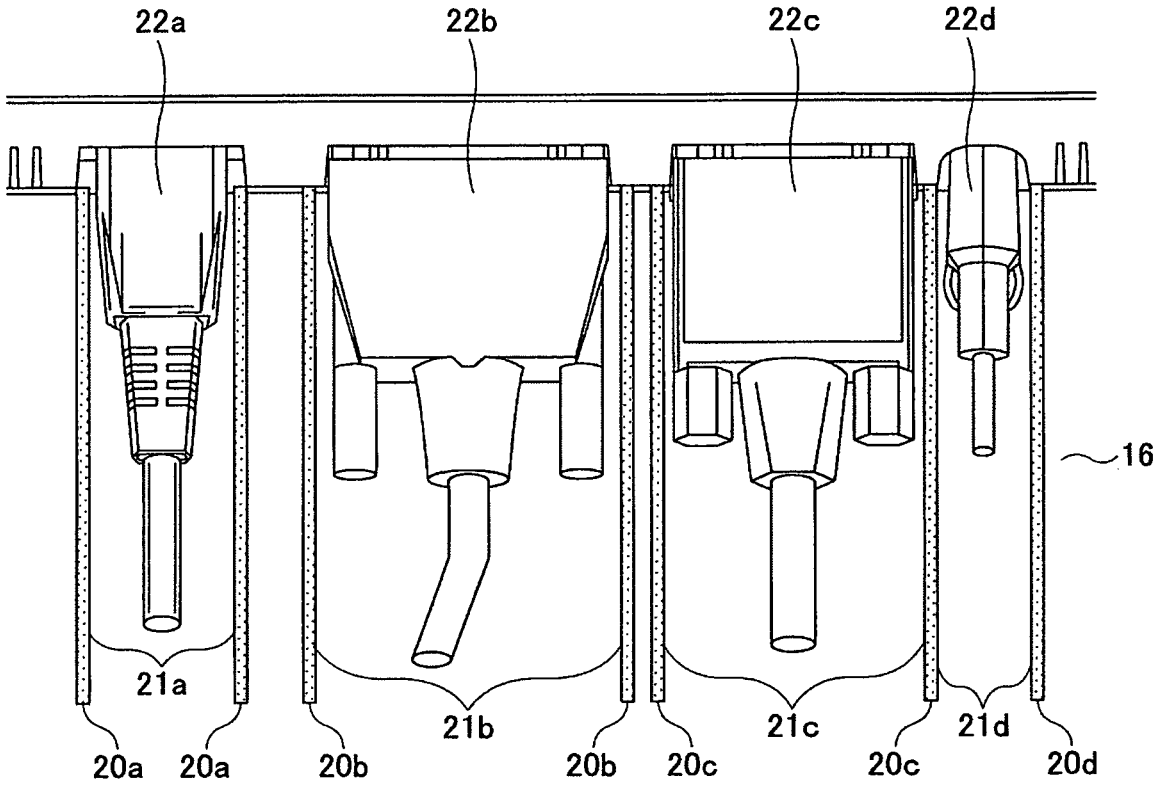
FIG. 10 is a view illustrating a state connection connectors are connected to the respective connectors illustrated in FIG. 2.

FIG. 10 is a view illustrating a state where the connection connectors 22*a*, 22*b*, 22*c* and 22*d* are connected to the connectors 18*a*, 18*b*, 18*c* and 18*d* illustrated in FIG. 2, respectively. The connectors 18*a*, 18*b*, 18*c* and 18*d* do not appear in the figure because they are hidden by the connection connectors 22*a*, 22*b*, 22*c* and 22*d*. Because the width direction guide surfaces and the height direction guide surfaces according to the above-mentioned embodiment are provided, even when the connectors 18*a*, 18*b*, 18*c* and 18*d* cannot be visually recognized, the connection connectors 22*a*, 22*b*, 22*c* and 22*d* can be easily connected to the connectors 18*a*, 18*b*, 18*c* and 18*d* so as to apply a cable wiring connection to the monitor device 10.

Figure 11:
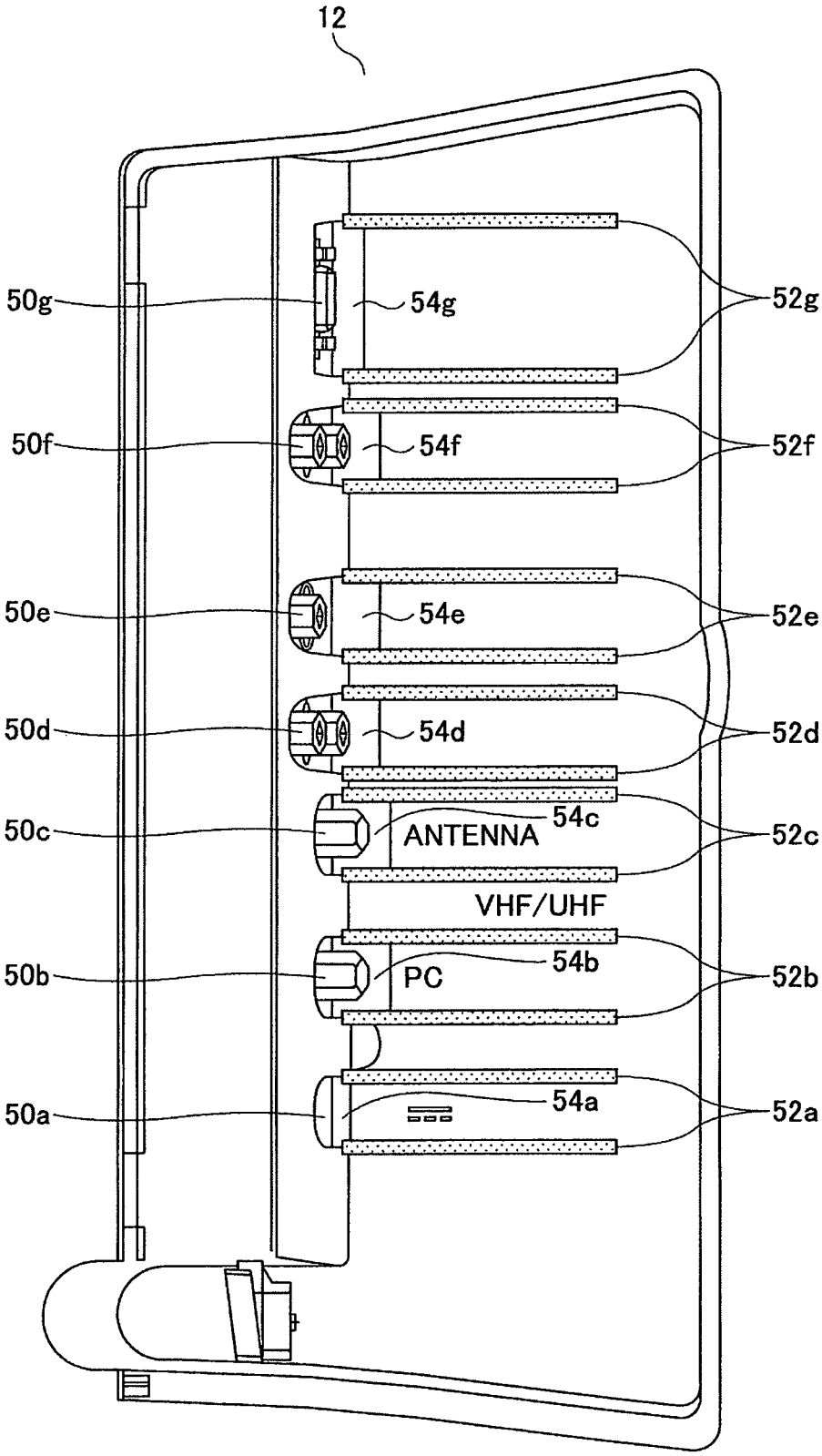
FIG. 11 is a view of connector provided on a side face of a monitor device.

The guide function according to the above-mentioned first and second embodiments can be applied to a case where connectors are provided on the side surface of the housing. FIG. 11 is a view illustrating a part of the side surface of the housing in which connectors are provided.

In the example shown in FIG. 11, guide molds 52*a*-52*g* and raised portions 54*a*-54*g* are provided to the connectors 50*a*-50*g* provided on the side surface of the housing 12 of the monitor device 10, respectively.

Similar to the guide molds 20*a*-20*d* illustrated in FIG. 2, the guide molds 52*a*-52*g* provide width direction guide surfaces for guiding the connection connectors 50*a*-50*g* in a direction of width, respectively. Additionally, Similar to the raised portions 24*a*-24*d* illustrated in FIG. 2, the raised portions 54*a*-54*g* provide height direction guide surfaces for guiding the connectors 50*a*-50*g* in a direction of height.

Because the guide molds 52*a*-50*d* and the raised portions 54*a*-54*g* are provided, the connection connectors (not illustrated in the figure) can be easily guided to the positions of the connectors 50*a*-50*g* and easily connected to the connectors 50*a*-50*g*, respectively.

A description will be given of a structure according which a type of a connector can be easily recognized even when the connector cannot be recognized visually. According to the above-mentioned first and second embodiments, if, for example, the connector 18*a* cannot be recognized visually but an approximate position of the connector 18*a* is found, the connection connector 22*a* can be moved to the connecting position of the connector 18*a* placing the connection connector 22*a* between the guide projection parts or inside the guide concave part and moving toward the connector 18*a*. However, because the monitor device 10 is equipped with four connectors 18*a*, 18*b*, 18*c* and 18*d*, if the connectors on the monitor device 10 cannot be recognized visually, it is difficult to identify which guide projection part or guide concave part corresponds to a connector to be connected. Thus, even in a case where the connectors cannot be recognize visually, the connectors 18*a*, 18*b*, 18*c* and 18*d* are caused to be identified by using the structure explained below.

Figure 12A:
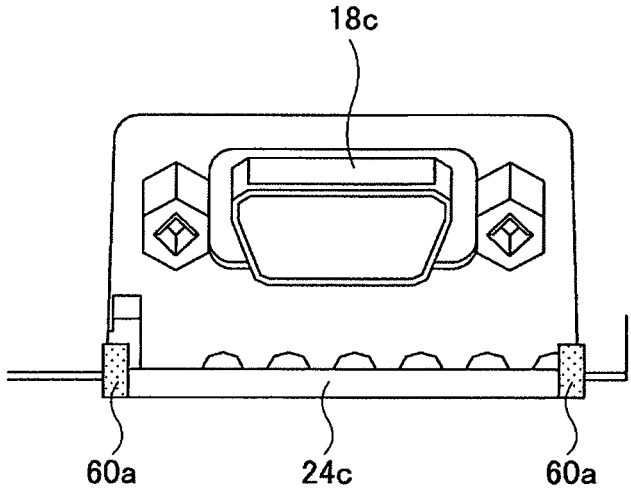
FIG. 12A is a view indicating a shape of a guide protruding part
Figure 12B:
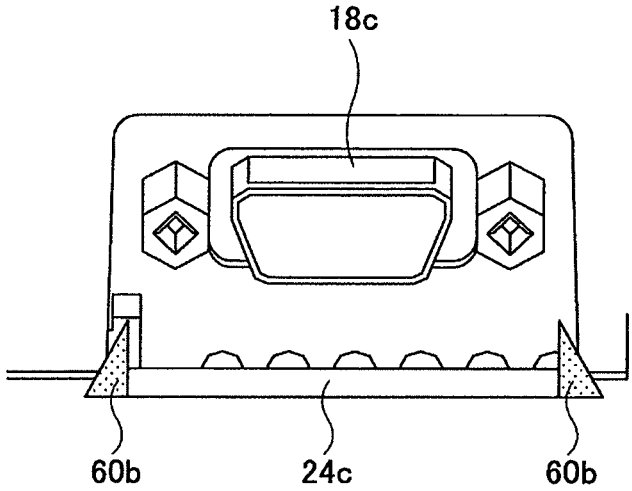
FIG. 12B is a view indicating another shape of the guide protruding part.
Figure 12C:
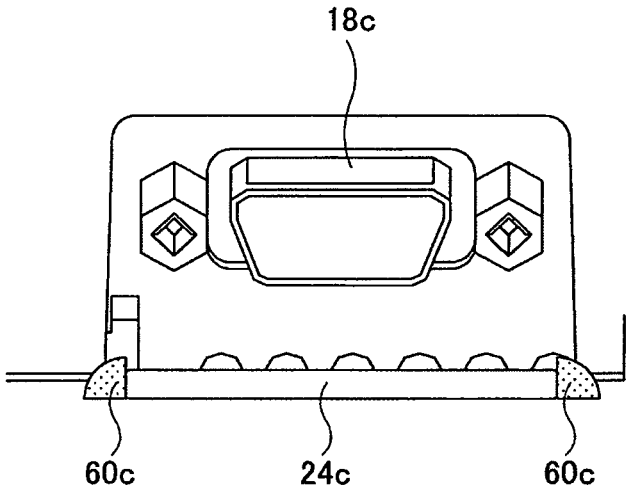
FIG. 12C is a view indicating a further shape of the guide protruding part.

First, when a pair of guide projection parts (guide molds or metal plate guide parts) are provided as in the first embodiment, by changing the shapes of top parts of the guide projection parts as illustrated in FIGS. 12A, 12B and 12C, each of the guide projection parts can be identified as to which connector corresponds to the guide projection part concerned by touching the top parts by a finger. The guide projection part 60*a* illustrated in FIG. 12A has a rectangular cross-section. The guide projection part 60*b* illustrated in FIG. 12B has a triangular cross-section. The guide projection part 60*c* illustrated in FIG. 12C has a fan-shaped cross-section (¼ of a circle).

For example, if the guide projection part 60*a* having a rectangular cross-section is used as a guide projection part corresponding to the connector 18*a*, the guide projection part 60*b* having a triangular cross-section is used as a guide projection part corresponding to the connector 18*b*, and the guide projection part 60*c* having a fan-shaped cross-section is used as a guide projection part corresponding to the connector 18*c*, the shape of each of the guide projection parts can be identified by touching by a finger and recognize which connector corresponds to the identified guide projection part. In this case, when connecting, for example, the connection connector 20*c* to the connector 18*c*, first identifying a pair of guide projection parts 60*c* having the fan-shaped cross-section by touching the guide projection pats by a finger tip, and placing the connection connector 20*c* between the identified guide projection parts. Then, by moving the connection connector 20*c* along the guide projection parts 60*c* having the fan-shaped cross-section, the connection connector 20*c* is guided by the guide projection parts having a fan-shaped cross-section and is lead to the connecting position of the connector 18*c*. There is no need to visually recognize the connector 18*c* in the above-mentioned operation, and the connector 22*c* can be connected to the connector 18*c* according to mere a feel of touching by a finger tip.

As mentioned above, a pair of guide projection parts are separately provided to each of the plurality of connectors 18*a*, 18*b*, 18*c* and 18*d*, and a pair of width direction guide surfaces correspond to the opposing side surfaces of the pair of guide projection parts projecting from the surface of the housing. The cross-sectional shape of each of the pair of guide projection parts corresponding to one of the plurality of connectors 18*a*, 18*b*, 18*c* and 18*d* is different from the cross-sectional shapes of the guide projection parts corresponding to other connectors from among the connectors 18*a*, 18*b*, 18*c* and 18*d*. Thereby, by identifying the cross-sectional shape of the guide protruding parts by touching by a finger tip, a type of a connector corresponding to the identified cross-sectional view can be identified.

Alternatively, a mark part of which shape can be varied may be provided to the bottom surface 16*b* of the concave part 16 between a pair of guide projection parts in the above-mentioned first embodiment. In the above-mentioned second embodiment, a mark part can be provided on the bottom surface of the guide concave part.

Figure 13:
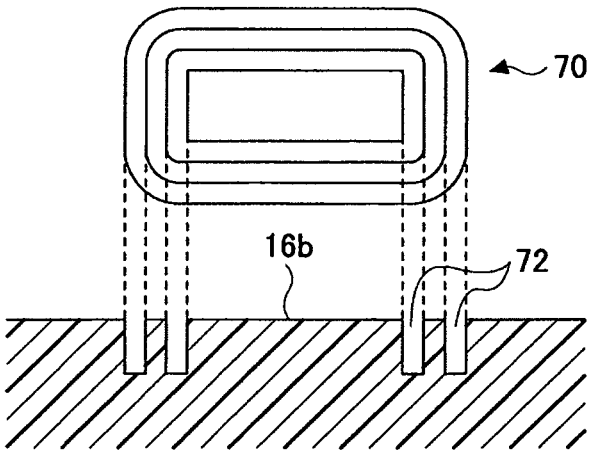
FIG. 13 is a cross-sectional view of a mark part formed by concave parts.
Figure 14:
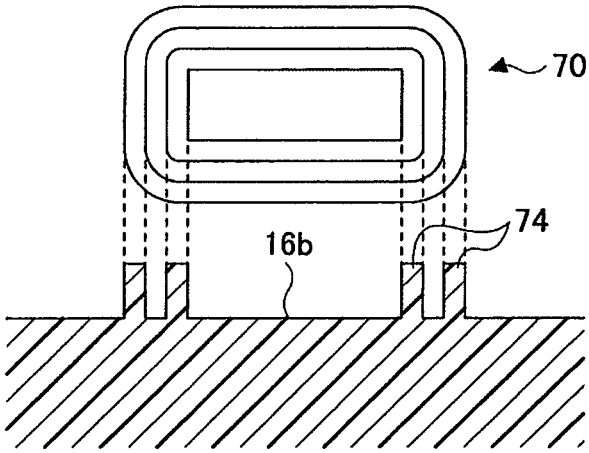
FIG. 14 is a cross-sectional view of a mark part formed by convex parts.

The mark part is provided by forming various shapes or patterns on the bottom surface 16*b* of the concave part 16. For example, the mark part 70 can be provided by forming a groove or recessed part 72 of a specific pattern on the bottom surface as illustrated in FIG. 13. Alternatively, the mark part 70 can be provided by forming a projection part 74 of a specific pattern on the bottom surface as illustrated in FIG. 14.

If the mark parts 70 provided to the plurality of connectors 18*a*, 18*b*, 18*c* and 18*d* have different shapes or patterns, by recognizing the mark part by touching the shape of the mark part by a finger tip, a type of a connector corresponding to the recognized mark part can be identified.

Figure 15:
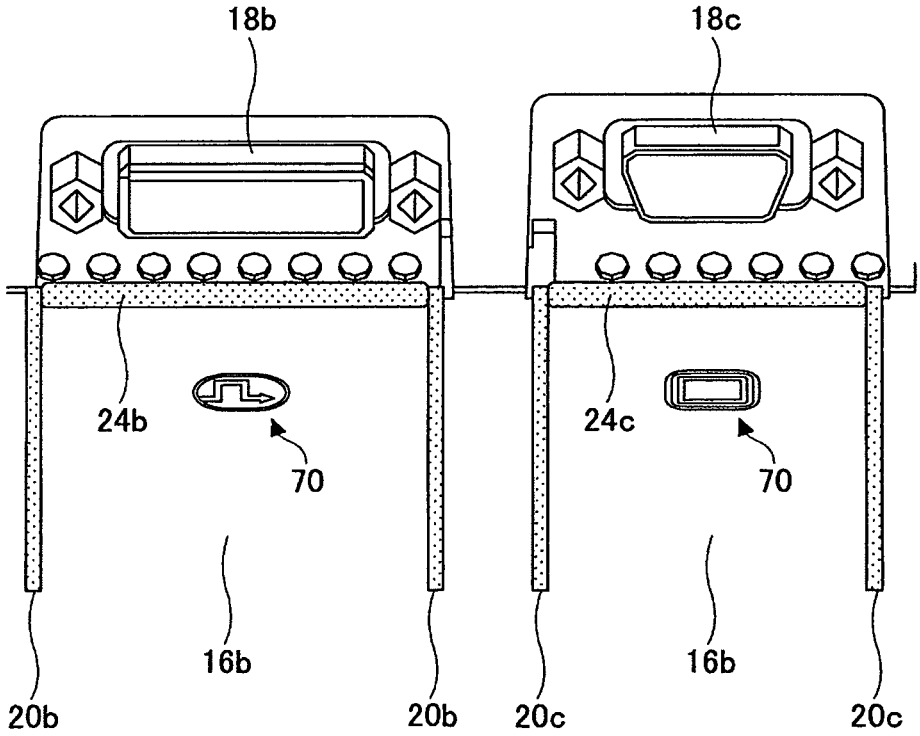
FIG. 15 is a view of a mark part using a connector identification icon.

For example, by using generally used connector identification icons of a computer as illustrated in FIG. 15 for the shape and pattern of the mark part 70, a type of a connector can be identified by touching the mark part 70 by a finger tip.

Figure 16:
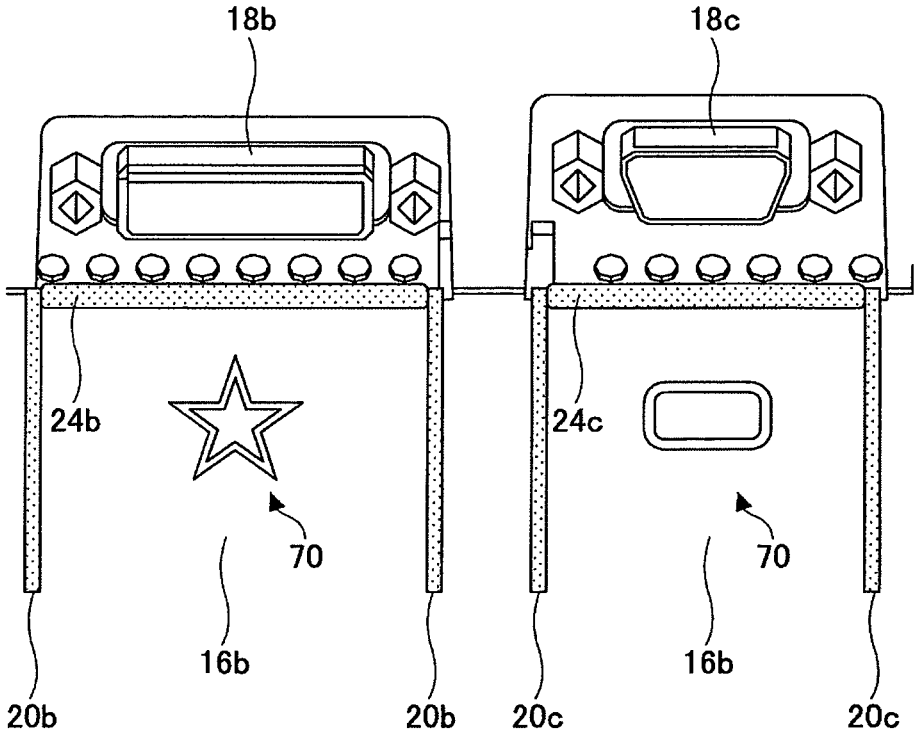
FIG. 16 is a view of a mark part using a simple shape.

Moreover, by using simple shapes such as a star or a rectangle as illustrated in FIG. 16 for the shape and pattern of the mark part 70, a type of a connector can be identified by touching the mark part 760 by a finger tip. In this case, for example, it is previously determined that the star corresponds to the type of the connector 18*b* and the elongated rectangle corresponds to the type of the connector 18*c*.

Figure 17:
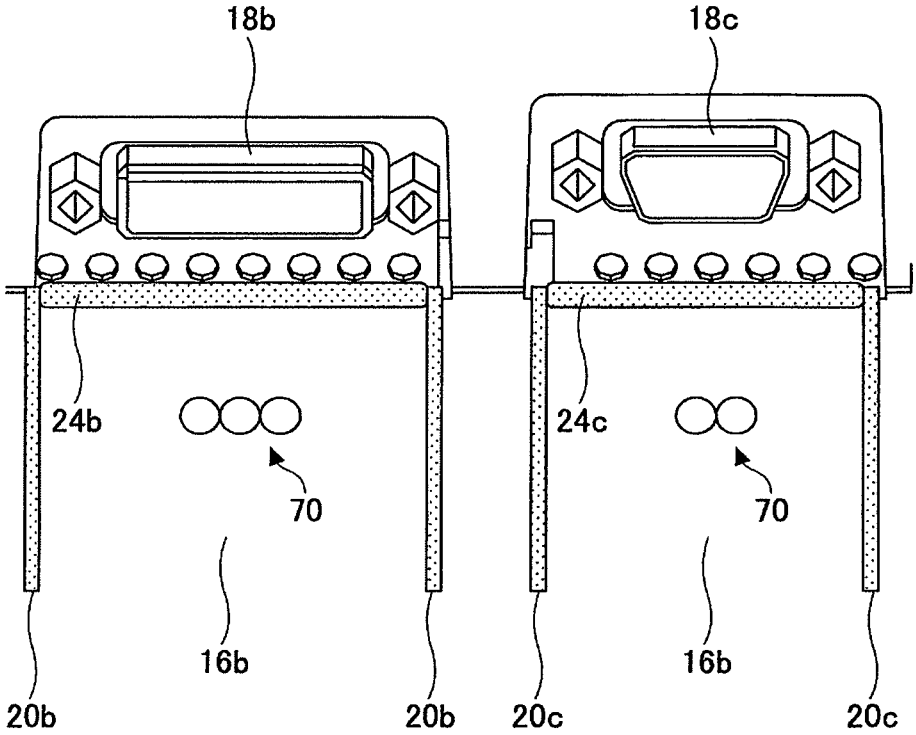
FIG. 17 is a view of a mark part to identify a type of a connector according to a number of circles.
Figure 18A:
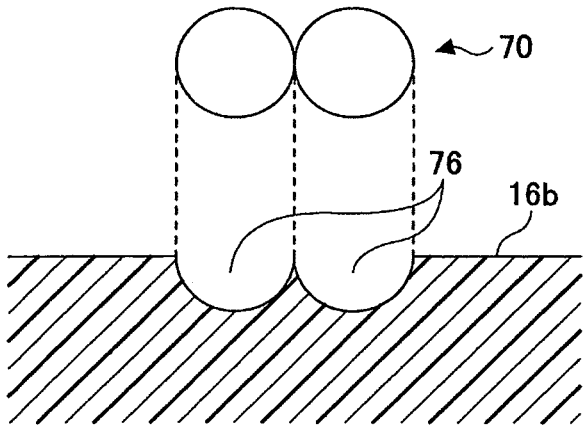
FIG. 18A is a cross-sectional view of a part indicating the circles by concave parts.
Figure 18B:
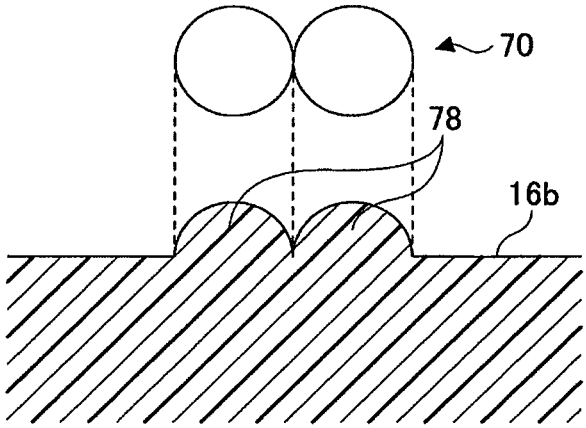
FIG. 18B is a cross-sectional view of a part indicating the circles by convex parts.
Figure 19:
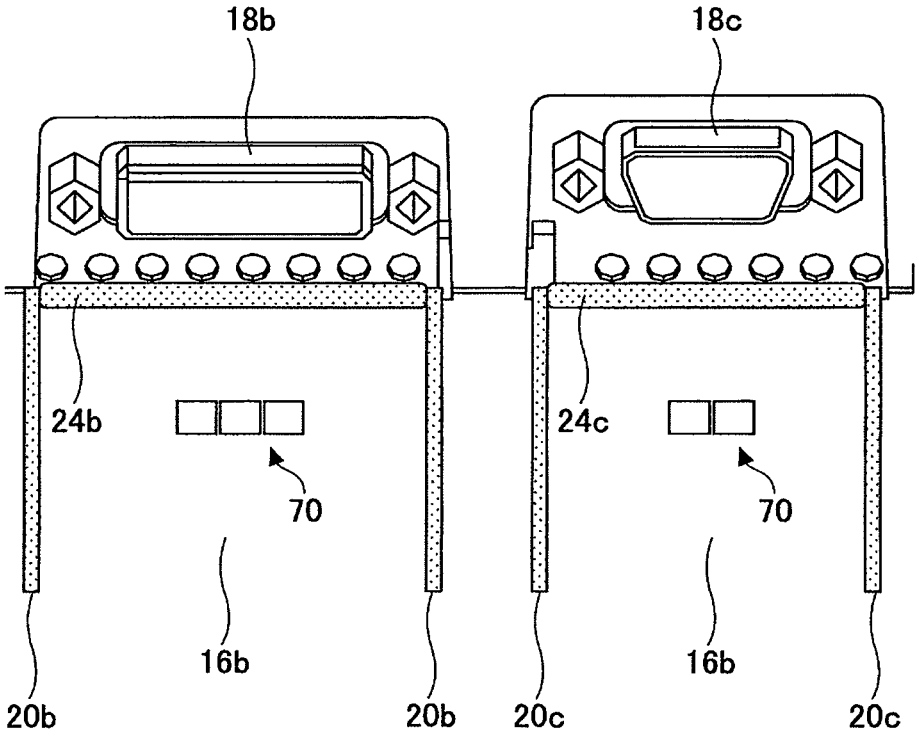
FIG. 19 is a view of a mark part to identify a type of a connector according to a number of squares.
Figure 20A:
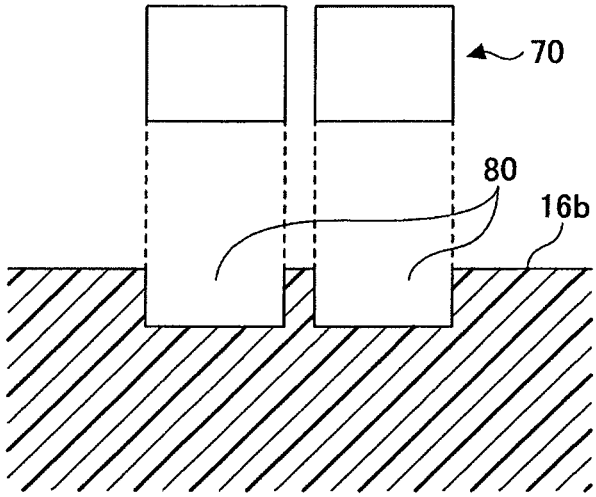
FIG. 20A is a cross-sectional view of a part indicating the squares by concave parts.
Figure 20B:
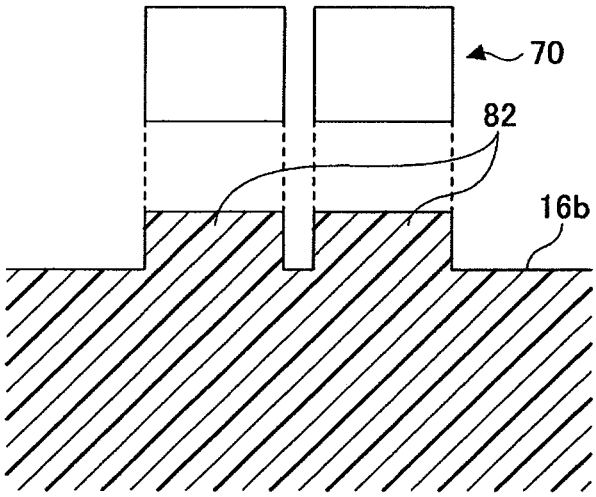
FIG. 20B is a cross-sectional view of a part indicating the squares by convex parts.

Alternatively, a type of a connector can be identified by a number of projection parts or recessed parts of a simple shape such as a circle or a square as a shape or pattern of the mark part 70. In this case, for example, it is previously determined that if the number of projection parts or the recessed parts of the mark part 70 is three (3), the mark part 70 corresponds the type of the connector 18*b*, and if the number of projection parts or the recessed parts of the mark part 70 is two (2), the mark part 70 corresponds the type of the connector 18*c*. FIG. 17 is a view indicating an example where a type of a connector is identified by a number of circles formed as the mark part 70. FIG. 18A is an illustration indicating the recessed parts 76 of circles forming the mark part 70. FIG. 18B is an illustration indicating the projection parts 78 of circles forming the mark part 70. FIG. 19 is a view indicating an example where a type of a connector is identified by a number of squares formed as the mark part 70. FIG. 20A is an illustration indicating the recessed parts 80 of squares forming the mark part 70. FIG. 20B is an illustration indicating the projection parts 82 of squares forming the mark part 70.

Figure 21:
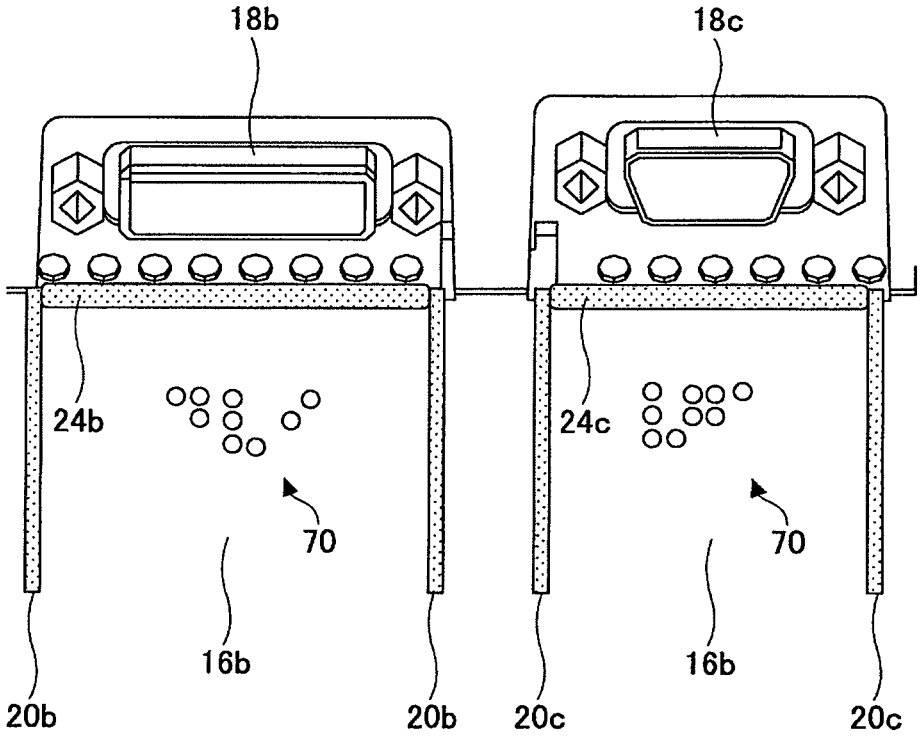
FIG. 21 is a view of a mark part to identify a type of a connector according to Braille.

Moreover, Braille notation may be used as the mark part 70 as illustrated in FIG. 21. In this case, the Braille notation itself expresses the type of the connector. In FIG. 21, the Braille of the mark part 70 used for the connector 18*b* expresses "DIV" and the Braille of the mark part 70 used for the connector 18*c* expresses "VGA".

All examples and conditional language recited herein are intended for pedagogical purposes to aid the reader in understanding the principles of the invention and the concepts contributed by the inventor to furthering the art, and are to be construed a being without limitation to such specifically recited examples and conditions, nor does the organization of such examples in the specification relates to a showing of the superiority and inferiority of the invention. Although the embodiment(s) of the present invention(s) has(have) been described in detail, it should be understood that the various changes, substitutions, and alterations could be made hereto without departing from the spirit and scope of the invention.

What is claimed is:

1. An electronic apparatus equipped with a connector, comprising:

an apparatus housing accommodating component parts of said electronic apparatus;

the connector provided to a surface of said apparatus housing; and a guide part provided to and projected from said apparatus housing and configured to guide a connection connector, which is to be connected to said connector, to a connecting position, wherein said guide part includes a pair of width direction guide surfaces and a height direction guide surface, the width direction guide surfaces guiding said connection connector to the connecting position with respect to a direction of width of said connector by sandwiching said connection connector therebetween in the direction of width, said height direction guide surface guiding said connection connector to the connecting position with respect to a direction of height of said connector in a state where said connection connector is in contact with said height direction guide surface.

2. The electronic apparatus as claimed in claim 1, wherein said pair of width direction guide surfaces are side surfaces of a guide projection part projecting from the surface of the apparatus housing.

3. The electronic apparatus as claimed in claim 2, wherein said apparatus housing is a plastic mold product, and said guide projection part is a plastic part integrally formed with said apparatus housing.

4. The electronic apparatus as claimed in claim 2, wherein said guide projection part is a part of a metal plate part provided in said apparatus housing, and is projecting to outside said apparatus housing through an opening provided in said apparatus housing.

5. The electronic apparatus as claimed in claim 1, wherein a distance between said pair of width direction guide surfaces is gradually reduced toward said connector.

6. The electronic apparatus as claimed in claim 1, wherein said pair of width direction guide surfaces are opposing side surfaces of guide concave parts formed on the surface of said apparatus housing.

7. The electronic apparatus as claimed in claim 6, wherein said apparatus housing is a plastic mold product, and said guide concave part is a recess formed simultaneously with formation of said apparatus housing.

8. The electronic apparatus as claimed in claim 1, wherein said connector is provided at a position on a rear surface of a side surface of said apparatus housing, the position being not viewed from a front side of said electronic apparatus.

9. The electronic apparatus as claimed in claim 1, wherein a plurality of said connectors are provided and said guide part is provided to each of said plurality of connectors;

said pair of width direction guide surfaces are opposing surfaces of a pair of guide projection parts projecting from the surface of said apparatus housing; and a cross-sectional shape of each of said pair of guide projection parts corresponding to one of said plurality of connectors is different from a cross-sectional shape of each of said pair of guide projection parts corresponding to other connectors from among said plurality of connectors.

10. The electronic apparatus as claimed in claim 1, wherein a plurality of said connectors are provided, and said guide part is separately provided to each of said connectors; and a mark part to identify a type of each of said connectors is provided near each of said plurality of connectors.

11. The electronic apparatus as claimed in claim 10, wherein a shape of said mark part corresponding to one of said plurality of connectors is different from shapes of said mark parts corresponding to other connectors from among said plurality of connectors.

12. The electronic apparatus as claimed in claim 11, wherein each of said mark parts has a shape indicating a shape expressing a type of one of said connectors.

13. The electronic apparatus as claimed in claim 11, wherein each of said mark parts is a recessed part or a projection part expressing a shape corresponding to a type of one of said connectors.

14. The electronic apparatus as claimed in claim 11, wherein each of said mark part includes recessed parts or projection parts of which number corresponds to a type of one of said connectors.

15. The electronic apparatus as claimed in claim 11, wherein each of said mark parts contains Braille expressing a type of one of said connectors.

* * * * *